US006086406A

United States Patent [19]

Francois et al.

[11] Patent Number: 6,086,406

[45] Date of Patent: Jul. 11, 2000

[54] BRANCHING CONNECTOR FOR AN UNDERGROUND CABLE

[75] Inventors: Pierre Francois, Limoges; Eric Sauer, Vrigne aux Bois, both of France

[73] Assignee: Societe Industrielle de Construction d'Apareils et de Materiel Electriques, Pompadour Cedex, France

[21] Appl. No.: 09/117,408

[22] PCT Filed: Jan. 28, 1997

[86] PCT No.: PCT/FR97/00162

§ 371 Date: Jul. 27, 1998

§ 102(e) Date: Jul. 27, 1998

[87] PCT Pub. No.: WO97/28578

PCT Pub. Date: Aug. 7, 1997

[30] Foreign Application Priority Data

Jan. 29, 1996 [FR] France ..... 96/00980

[51] Int. Cl.[7] ..... H01R 4/26

[52] U.S. Cl. ..... 439/402; 439/411; 439/413; 439/781; 439/412

[58] Field of Search ..... 439/402, 411, 439/412, 413, 431, 435, 781, 797, 798, 933

[56] References Cited

U.S. PATENT DOCUMENTS

| | | | |
|---|---|---|---|
| 3,118,715 | 1/1964 | Potruch | 439/402 |
| 3,258,733 | 6/1966 | Elm | 439/402 |
| 3,688,246 | 8/1972 | Toedtman et al. | 439/412 |
| 4,643,512 | 2/1987 | Prodel | 439/781 |
| 4,973,262 | 11/1990 | Gerke et al. | 439/395 |
| 4,985,003 | 1/1991 | Francois et al. | 439/781 |
| 5,015,198 | 5/1991 | Delin | 439/411 |
| 5,302,144 | 4/1994 | Francois et al. | 439/781 |
| 5,520,549 | 5/1996 | Tanaka et al. | 439/402 |

FOREIGN PATENT DOCUMENTS

| | | |
|---|---|---|
| 0340075 | 4/1989 | European Pat. Off. . |
| 2601516A2 | 6/1986 | France . |
| 2277208 | 10/1994 | United Kingdom . |
| 2277208 | 11/1994 | United Kingdom . |
| WO 95/15593 | 6/1995 | WIPO . |

*Primary Examiner*—Paula Bradley
*Assistant Examiner*—Tho D. Ta
*Attorney, Agent, or Firm*—Howrey simon Arnold & White, LLP

[57] ABSTRACT

A branch connector for an underground cable enabling a main cable to be electrically connected to at least one branch cable, each being constituted by a metal core surrounded by an insulating sheath, and comprising a lower body (10) and an upper body (12) disposed facing each other and movable towards each other by clamping, each body including a contact element (16, 18; 50) which is made, at least in part, of metal and which is situated in a plane extending transversely relative to an axial direction of the cables and penetrating both through the insulation of the main cable and through the insulation of the branch cable to make contact with the cores of said cables when the upper and lower bodies are moved towards each other by at least one clamping means (14), and a movable non-conductive separator member (70) situated in the midplane of the connector and designed to enable two branch cables to be assembled without coming into contact with each other.

10 Claims, 2 Drawing Sheets

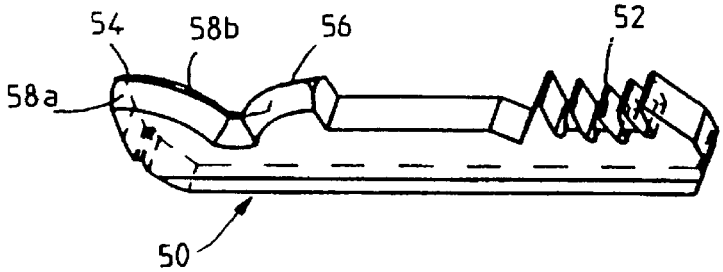
FIG.6
FIG.7a
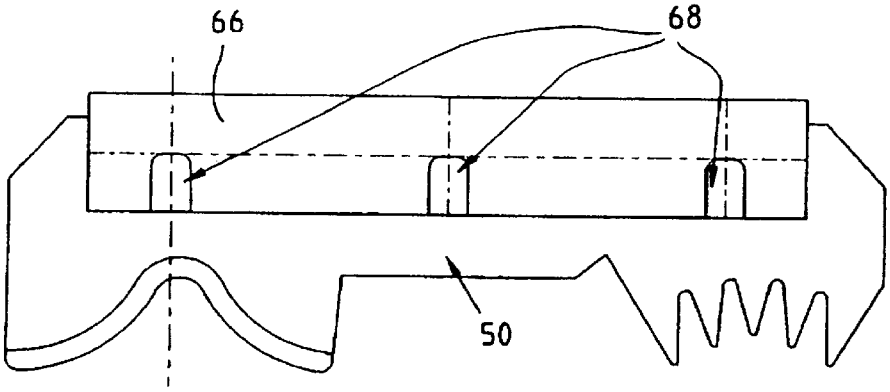
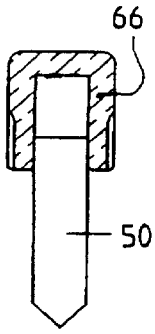
FIG.7b
FIG.8
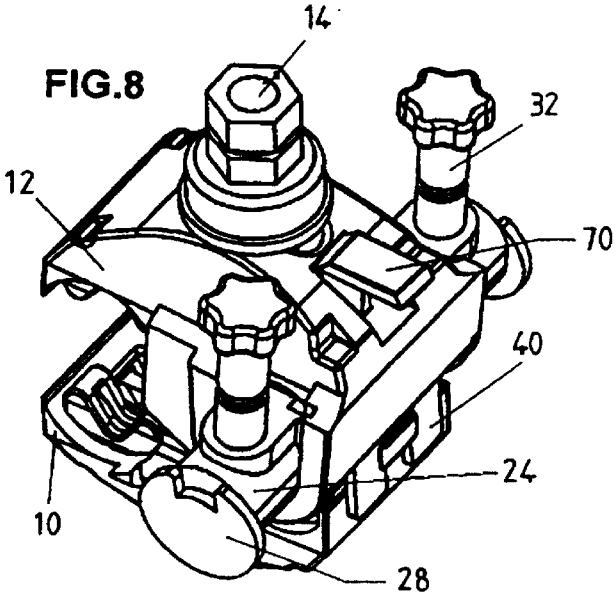
FIG. 9
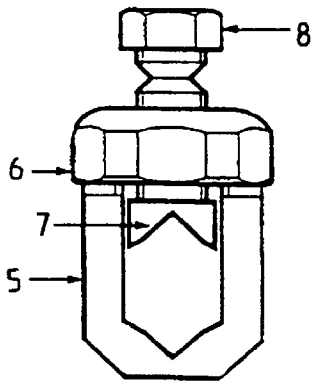

BRANCHING CONNECTOR FOR AN UNDERGROUND CABLE

CROSS REFERENCE TO RELATED APPLICATIONS

BACKGROUND OF THE INVENTION

1. Field of the Invention

This application claims the benefit of French Patent Application No. 96/00980 filed on Jan. 29, 1996.

The present invention relates to a branch connector for an underground cable enabling an electrical and mechanical connection to be made between a main or "through" cable of circular section or of so-called "sectoral" non-circular section, and a secondary cable or "branch" cable of circular or of sectoral section.

2. Description of Related Art

FIG. 9 shows a connection device in widespread use at present in the field of underground networks and it is constituted essentially of metal parts, having a body 5 surmounted by a self-locking cap 6 acting via a presser member 7 to provide a mechanical and electrical joint between the cables to be interconnected, and which operates on the basis of mechanical clamping, e.g. by means of a screw 8, or by crimping. As a result, when such an underground connector is to be put into place, it is necessary firstly to strip both the through cable and the branch cable and then, once the joint has been established, to apply insulation either by means of an insulating cover or by means of flexible insulating sheath.

As a result, that known device for connecting underground cables together suffers from numerous drawbacks. Firstly, the requirement for stripping the cables gives rise to an operation that is lengthy, awkward, and sometimes even dangerous since in the particular field of underground cable networks, it very often happens that the main cable is live and cannot be disconnected without giving rise to severe penalties for users of the electrical network of which it forms a part. The connection device is at a live potential, as are the clamping screws or the crimping tools. Consequently, the person (or jointer) who needs to access the live main cable is also taken to high potential when acting on the cable, thus requiring special protection (e.g. a special trench suit). Thereafter the connection device still needs to be insulated after it has been put into place, which implies a further difficult operation, since that too must be performed on parts that are live. Finally, with that type of prior art connector, it is essential to separate the various conductors of the main cable from one another so as to be able to pass a connector body around each conductor.

SUMMARY OF THE INVENTION

An object of the present invention is to mitigate the above-mentioned drawbacks by providing a branch connector that does not require the cables that are to be interconnected to be stripped, nor does it require any insulation after assembly. An essential object of the invention is to make a branch connector that can be fitted quickly, that is of high quality, and that is entirely safe for the jointer. Another object is for the branch connector of the invention to guarantee good dielectric behavior and natural positioning of the main cable without it being necessary to take action inside the bundle of conductors that it may contain.

These objects are achieved by a branch connector for an underground cable enabling a main cable to be electrically connected to at least one branch cable, each of the cables being constituted by a metal core surrounded by an insulating sheath, the connector being characterized in that it comprises a lower body and an upper body disposed facing each other and movable towards each other by clamping, each body including a contact element which is made, at least in part, of metal and which is situated in a plane extending transversely relative to an axial direction of the cables and penetrating both through the insulation of the main cable and through the insulation of the branch cable to make contact with the cores of said cables when the upper and lower bodies are moved towards each other by at least one clamping means, and in that it further includes a movable non-conductive separator member situated in the midplane of the connector and designed to enable two branch cables to be assembled without coming into contact with each other.

By having a connector of this particular structure, the joint is made quickly without stripping the cables and without requiring any special positioning of the cables that are to be interconnected. The presence of a separator member in the branch cable passage makes it possible to guarantee good electrical and mechanical jointing of the cables while facilitating assembly.

Preferably, the contact element includes, on either side of its midplane, firstly a set of spikes comprising at least two teeth pointing in a clamping direction, and secondly conductive cutting edges facing each other obliquely so as to leave a reflex angle between them.

Advantageously, the contact element is constituted by a blade of single thickness on which there is secured, e.g. by crimping, a channel section backing strip such that the resulting part presents improved mechanical and thermal characteristics because of its wider back.

The non-cutting and non-perforating portions of the contact element are covered in an insulating material forming an electrical insulation jacket. In this way, it is possible to guarantee very good dielectric behavior for the connection which is thus well insulated once the bodies have been moved towards each other by the clamping means.

Preferably, at least one bushing advantageously made of transparent material, is disposed in a plane perpendicular to the clamping direction to receive and hold the branch cable. With these bushings, the jointer no longer needs to hold the branch cable(s) when putting the connector into place on the main cable, thereby considering simplifying the manipulations the jointer needs to perform when connecting the cables. To reinforce the holding of the branch cables it is possible for each bushing to have engaged therein a holding screw, preferably a lock screw.

In a preferred embodiment, the clamping means comprises a screw passing through one of the bodies to make screw engagement in the other body and provided with insulation means to cover each of the ends of the screw, thereby enabling the screw to be driven without contacting live potential. By means of this-protection, there is no longer any need subsequently to add insulation after the connection has been made, and the person making the interconnection is no longer required to wear a trench suit as was previously essential when operating on live parts. This makes it much easier to ensure the safety of said person (the jointer).

The clamping means includes a torque limiter for ensuring that clamping takes place at a predetermined torque independently of the clamping torque exerted. In this way, it is possible to guarantee that assembly is completely reproducible and entirely reliable regardless of the particular person making the interconnection.

The branch connector of the invention further includes a breakable spacer means which holds the connector open during assembly and which is broken during clamping. By way of example, the breakable spacer means is constituted by a tongue having a zone of weakness designed to be broken during clamping, said tongue being secured to one of the two bodies and extending towards the other body into a cavity designed to receive it.

BRIEF DESCRIPTION OF THE DRAWINGS

Other features and advantages of the present invention appear from the following description with reference to the accompanying drawings, in which:

FIG. 6 is a perspective view of the contact element;

FIGS. 7*a* and 7*b* show another embodiment of the contact element;

FIG. 8 is a perspective view of a connector of the invention provided with a separation plate enabling a main cable to be joined to two branch cables; and FIG. 9 shows a prior art branch connector.

DETAILED DESCRIPTION OF THE INVENTION

Figure 1:
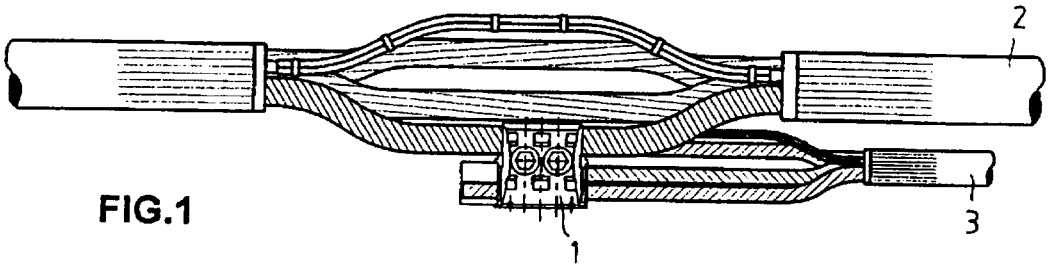
FIG. 1 shows the branch connector of the invention providing a joint between a main cable and a secondary cable.

FIG. 1 shows a joint made using a branch connector 1 of the invention between a main cable 2 and a secondary cable 3. The main cable, also known as the "through" cable, is of the multiwire type, e.g. having four bundles of wires (three phases and one neutral), with each bundle being insulated using either a synthetic dry insulator such as polyvinyl chloride (PVC), or a chemically cross-linked polyethylene (XLPE), or else oil-impregnated paper. The conductive core of such a bundle is generally made of solid or multistrand twisted aluminum, or of copper. The secondary cable, also known as the "branch" cable, may also be of the insulated multiwire type.

Figure 3:
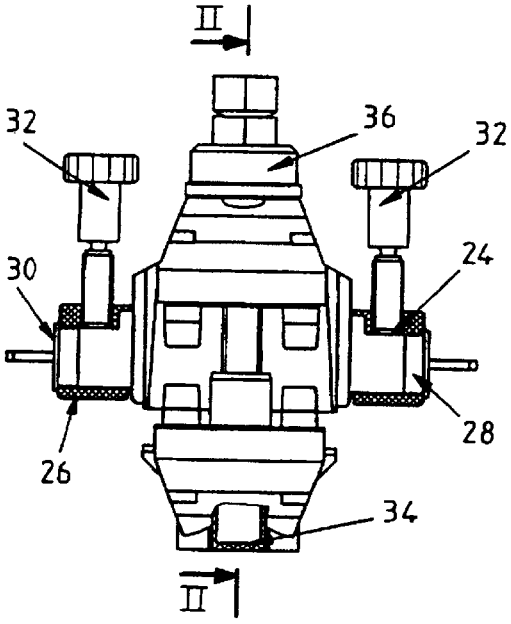
FIG. 3 is a view seen along axis F in FIG. 2 with two fragmentary sections through the inlet bushings for the branch cable.
Figure 2:
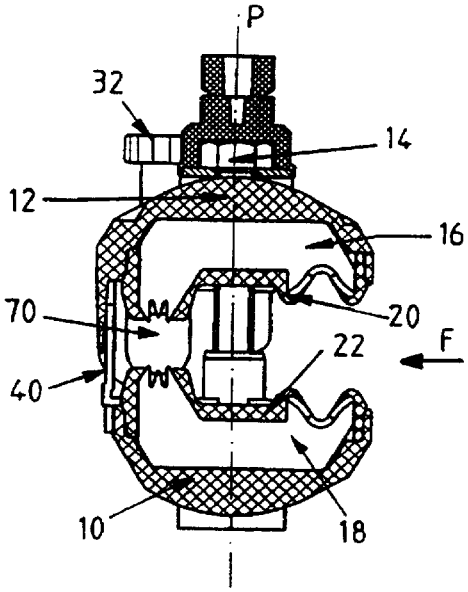
FIG. 2 is an elevation view in section through a branch connector of the invention on plane II—II of FIG. 3.

FIGS. 2 and 3 are general views of a particular embodiment of a branch connector of the invention.

The connector shown comprises a lower body 10 and an upper body 12 which can be moved towards each other in a clamping direction by clamping means comprising at least one clamping screw 14 lying in a midplane P of the connector and passing through one of the bodies for screw engagement in the other body. Each of the upper and lower bodies, which is preferably made of an insulating material such as a glass fiber filled crystalline thermoplastic or a plastics material, is fitted with a contact element 16, 18 intended, when the connector is installed, to provide electrical contact between the two cables to be interconnected. Over a central portion 20 or 22 and over end portions 19 or 21 that correspond to non-puncturing or non-cutting zones of said elements, each contact element is covered in a thermoplastic elastomer material (e.g. a gum), thereby forming an electrically insulating jacket. By using such an insulating material, it is possible to guarantee very good dielectric behavior for the connection since it is well insulated in this way. Bushings 24 and 26 for receiving the branch cable and advantageously made of a transparent thermoplastic material are available on either side of the upper or the lower body, extending in a direction perpendicular to the clamping direction, and secured to one of the bodies, e.g. the upper body 12. The bushing that is not used can be closed by a plug 28, 30. Thus, when installing a single branch cable, the transparent bushings make it possible to ensure that the cable is inserted fully into the connector. It will be observed that, providing the connector also includes a central moving separator plate of non-conductive material 70 (see FIG. 8 which is a perspective view of a connector provided with such a plate), the connector is also suitable for use simultaneously with two branch cables. The initially-raised plate cannot be lowered into the branch cable passage unless both branch cables are appropriately inserted into their respective bushings. A lock screw type holding device 32 for keeping the branch cable in position can be fixed to each of the bushings to ensure better centering and better retention of the cable (which screw can be made of synthetic material). Insulation accessories 34, 36 can also be provided at each end of the clamping screw 14, in each of the two bodies, to prevent any direct contact with the clamping screw (in particular by the jointer). In addition, it is preferable to provide both a torque limiter 38 placed at the head of the clamping screw to guarantee clamping at predetermined torque, independently of the clamping torque exerted (the holding screw may also be of the type that breaks at predetermined torque), and a breakable spacer, e.g. formed by a tongue 40 fixed on one of the bodies and extending in the clamping direction into a cavity for receiving it, and having a zone of weakness 42 which is broken during clamping, the spacer serving to define a minimum spacing between the two bodies of the connector so as to hold the connector open during assembly operations prior to clamping.

Figure 4:
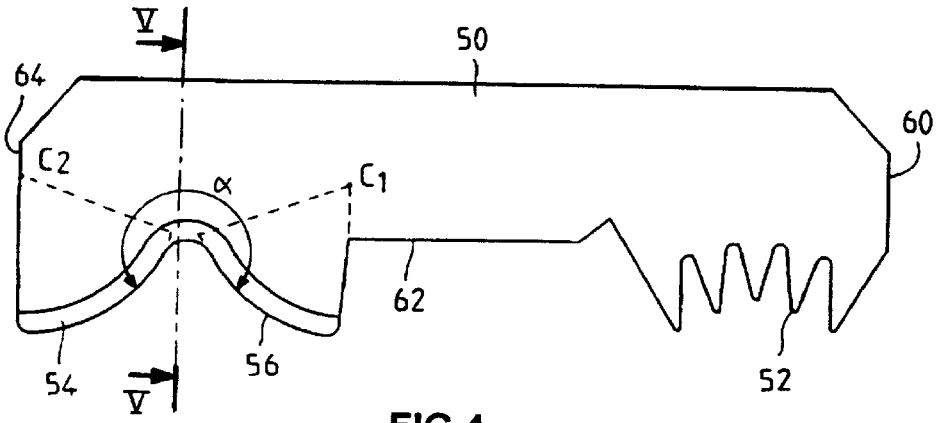
FIG. 4 shows a contact element of the connector of the invention.
Figure 5:
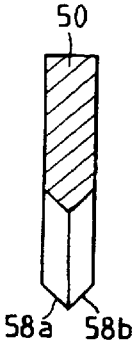
FIG. 5 is a section view on plane V—V of FIG. 4.

A preferred embodiment of the contact element is shown in greater detail in FIGS. 4, 5, and 6. It is in the form of a single metal blade 50 (at least the cutting and puncturing portions thereof are made of metal), e.g. copper of the tinned CuAl type that may optionally have been subjected to surface treatment. The blade is situated in a plane extending transversely relative to the axial direction of the cables to be connected together, preferably perpendicularly to said direction, and on opposite sides of the midplane it includes firstly a group of spikes 52 extending in the clamping direction and secondly two conductive cutting edges 54 and 56 facing each other obliquely so as to form between them a reflex angle $\alpha$. Each set, whether of spikes or of edges, is designed to co-operate with the identical set opposite to make contact with the cables to be interconnected, with the edges making it possible to engage a main cable of the "sectoral" type. There are at least two spikes (in the example shown the group of spikes has five spikes) and their ends are preferably disposed on a concave circular arc so as to provide a better grip on a circular branch cable. Nevertheless, to accommodate the large differences in section that can sometimes exist between a main cable and a branch cable, a simple linear disposition of the spikes with the spikes being of increasing length from the end to the center of the contact elements could also be envisaged. The number of teeth is selected as a function both of the amperage that it is to pass through the connector and the diameter of the cable to be connected. Similarly, the edges are preferably curved following a convex outline, e.g. along circular sectors over about 90° (as shown in FIG. 4), and they are placed in such a manner that the distance between the centers $C_1$, and $C_2$ of said ¼-circle sectors is equal to or s-lightly greater than twice their radius. Each edge is formed by the intersection of two faces 58*a* and 58*b* that are at an angle of about 90° to each other. It will nevertheless be observed that the edges could equally well be formed merely by rectilinear sectors. The portions 60, 62, 64 of the contact element disposed between and outside its puncturing and cutting portions 52 and 54 & 56 are covered in insulating material to form an electrical insulating jacket once the joint has been established. Naturally, a more conventional structure with two groups of spikes or with two blades could also be envisaged.

In order to increase the section for transferring electricity between the main cable and the branch cable, thereby obtaining good reliability and stability in the face of aging, and good behavior in the event of voltage surges, the blade 50 which is advantageously cut out from a standard metal strip using conventional low cost techniques, can be provided with a channel section metal backing strip 66 (see FIGS. 7*a* and 7*b*) crimped onto the blade at 68. This blade plus backing strip assembly has the effect of giving the blade a very wide back without requiring considerably more complex manufacture of a single part of upside-down T-shaped section, and also provides improved mechanical strength and increased ability to dissipate heat.

Installing the connector to make a joint with a single cable takes place as follows. Firstly with the connector in the unclamped position, the branch cable is inserted into one of the bushings 26 thereof, after the plug 30 has been removed from the bushing, with the branch cable being inserted until it comes into abutment in the opposite bushing 28. The branch cable is then held in place by the lock screw 32 (with snapping of said screw indicating that the cable is held properly). The connector remains open because of the presence of the breakable spacer, thereby enabling it to be positioned easily on the main cable, and then to be clamped by means of the screw 14. In addition, the particular shape of the sectors makes it possible to position the connector naturally on the main cable by self-centering. Initially clamping breaks the breakable spacer 40 and then simultaneously perforates both the main cable and the secondary branch cable, so as to come into contact with the conductive cores of said cables, with no stripping being required and without the jointer coming into contact with any metal part (in particular the clamping screw is protected by its insulation accessories 34 and 36). Snapping of the clamping screw 14 informs the jointer that the connector has become operational.

When making a joint with two branch cables, starting with the connector initially in the unclamped position and after removing both plugs 28 and 30, the first branch cable is inserted until it has passed right through the connector and can thus be seen through both bushings 24 and 26. Thereafter the second branch cable is inserted in turn into the connector from the opposite side pushing back the first branch cable until both branch cables are inserted by a comparable length into the connector. This is checked by acting on the moving plate 70 which can be pushed in properly only if it lies exactly between the two facing ends of the two branch cables. The branch cables can then be secured without coming into mutual contact by means of the lock screws 32.

The procedure for assembly onto the main cable then continues as described above.

The advantage of the present invention lies in the fact that during this operation of making a connection, no live potential (when working on live cables) nor even any floating potential (i.e. a potential that might come into contact with a live potential) is directly accessible to the jointer. The breakable spacer also greatly facilitates assembly since by keeping the connector open it avoids any need for the jointer to hold the connector open while positioning it on the main cable. The torque limiter serves to guarantee a constant clamping torque regardless of the particular person performing the jointing operation. The connector thus provides an electrical and mechanical joint with the electrical connection being insulated both because of its own insulating nature and because of the gum portions covering the non-cutting or non-puncturing portions of the contact blades.

What is claimed is:

1. A apparatus for connecting main and branch cables having metal cores and surrounding insulating sheathes, the apparatus comprising:

a first body;

a second body adapted to be positioned facing the first body;

a clamp capable of moving the second body towards the first body;

first and second contact elements being made, at least in part, of metal, being located in the first and second bodies, respectfully, the contact elements being substantially transverse to the axis along which the main cable lies when connected to the branch cable and being adapted to penetrate the insulation of the main and the branch cables and to make electrical contact with the cores of said cables in response to moving the first and second bodies towards each other with the clamp; and a movable non-conductive separator member being situated in a transverse plane of the apparatus, between two facing ends of two branch cables and being adapted to enable the two branch cables to be connected to the apparatus without making electrical contact therebetween.

2. The apparatus as set forth in claim 1, wherein the contact element includes:

a blade of a substantially uniform thickness; and a backing strip being mounted along a back edge of the blade and being made of metal.

3. The apparatus as set forth in claim 1, wherein the contact element comprises:

at least two teeth located on a clamping edge of the contact element, and at least two conductive cutting edges being located on the clamping edge and obliquely facing each other, the teeth and edges being located on opposite sides of a plane bisecting the contact element.

4. The apparatus as set forth in claim 1, wherein a majority of the non-cutting and non-perforating surface of the contact element is covered with an electrically insulating material.

5. The apparatus as set forth in claim 1, further comprising:

at least one bushing being positioned along an axis substantially perpendicular to the direction of movement of the bodies under action of the clamp and being adapted to receive and hold the branch cable.

6. The apparatus as set forth in claim 5, further including a holding screw adapted to fix the branch cable to the bushing.

7. The apparatus as set forth in claim 1, wherein the clamp comprises:

a screw passing through a first of the bodies and making a screw engagement in the second of the bodies, each of the ends of the screw being covered with insulation, the insulation enabling the screw to be screwed into the second of the bodies without electrically contacting either one of the bodies.

8. The apparatus as set forth in claim 7, wherein the clamp includes a torque limiter for limiting the tightening torque on the screw to a predetermined torque, the predetermined torque being substantially independent of the torque exerted on the screw.

9. The apparatus as set forth in claim 1, further including a breakable spacer to hold the first and second bodies apart and to break in response to moving the bodies together with the clamp.

10. The apparatus as set forth in claim 9, wherein the breakable spacer comprises:

a tongue having a zone of weakness, the zone of weakness adapted to be broken during clamping, said tongue being secured to one of the two bodies and extending towards the other body and into a cavity, the cavity being formed by the two bodies and adapted to receive the tongue.

* * * * *